US007438078B2

(12) United States Patent
Woodruff et al.

(10) Patent No.: US 7,438,078 B2
(45) Date of Patent: Oct. 21, 2008

(54) SLEEPING BAG AND SYSTEM

(76) Inventors: Peter Woodruff, 8692 S. 5170 West, West Jordan, UT (US) 84084; Ronald Shawn Naccarato, 7063 S. Swan Hill Dr., West Jordan, UT (US) 84094; Tony Reece, 1644 W. Clark La., Farmington, UT (US) 84025

( * ) Notice: Subject to any disclaimer, the term of this patent is extended or adjusted under 35 U.S.C. 154(b) by 0 days.

(21) Appl. No.: 11/198,776

(22) Filed: Aug. 5, 2005

(65) Prior Publication Data

US 2007/0028952 A1 Feb. 8, 2007

(51) Int. Cl.
*E04H 15/02* (2006.01)

(52) U.S. Cl. ..... 135/96; 135/97

(58) Field of Classification Search ..... 135/96, 135/124, 120.1, 95, 93, 94, 97, 143
See application file for complete search history.

(56) References Cited

U.S. PATENT DOCUMENTS

| | | | | |
|---|---|---|---|---|
| 1,805,415 | A * | 5/1931 | Pendarvis et al. | 190/2 |
| 3,840,919 | A | 10/1974 | Middleton | |
| 4,001,902 | A | 1/1977 | Hall et al. | |
| 4,057,859 | A | 11/1977 | Setterholm | |
| 4,308,883 | A | 1/1982 | Malone | |
| 4,531,330 | A | 7/1985 | Phillips | |
| 4,590,956 | A | 5/1986 | Griesenbeck | |
| 4,605,029 | A * | 8/1986 | Russell | 135/125 |
| 4,757,832 | A * | 7/1988 | Russell | 135/128 |
| 4,787,105 | A | 11/1988 | Phillips et al. | |
| 4,862,906 | A | 9/1989 | Jordon | |
| 5,125,547 | A * | 6/1992 | Russell | 224/637 |
| 5,210,888 | A | 5/1993 | Canfield | |
| 5,257,427 | A * | 11/1993 | Hinshaw | 5/613 |
| 5,449,014 | A | 9/1995 | Yan-ho | |
| 5,562,115 | A | 10/1996 | Sotelo | |
| 5,640,725 | A * | 6/1997 | Ando et al. | 5/413 AM |
| 5,669,088 | A | 9/1997 | McNamee | |
| 5,699,820 | A | 12/1997 | Evans et al. | |
| 5,881,405 | A | 3/1999 | Garrigues | |
| 6,167,898 | B1 | 1/2001 | Larga et al. | |
| 6,694,995 | B1 * | 2/2004 | Ransom | 135/128 |
| 2004/0025929 | A1 * | 2/2004 | Turner | 135/133 |
| 2005/0051203 | A1 | 3/2005 | McCully et al. | |

FOREIGN PATENT DOCUMENTS

GB 2196359 A * 4/1988

* cited by examiner

*Primary Examiner*—David R Dunn
*Assistant Examiner*—Noah Chandler Hawk
(74) *Attorney, Agent, or Firm*—Advantia Law Group; Michael W. Starkweather; Jason P. Webb

(57) ABSTRACT

There is a combination sleeping bag system. There is a tent member, including a tent base, a tent wall coupled to the tent base and defining a tent interior, and a tent aperture through the tent wall; and a sleeping bag defining a sleeping cavity, extending through the tent aperture, and including a head portion disposed within the tent interior, a foot portion disposed exterior the tent member, and a storage cavity accessible from the sleeping cavity.

20 Claims, 7 Drawing Sheets

SLEEPING BAG AND SYSTEM

BACKGROUND OF THE INVENTION

1. Field of the Invention

The present invention relates to camping equipment, specifically to tents, sleeping bags, and the like.

2. Description of the Related Art

In general, a sleeping bag is used in camping to provide warmth to a camper while sleeping. Typically a camper will also use a tent or bivy sack to protect the camper and/or the sleeping bag from insects, rain, snow, wind, dirt, plants, etc. A combination of a sleeping bag and a tent will generally protect a camper from a great variety of dangers and/or irritations that otherwise may afflict the camper while experiencing an outdoor adventure.

However, historically tents are large, heavy, and bulky. Some progress has been made in making tents and bivy sacks smaller, lighter, easier to carry by using advanced materials and altering designs to use fewer components. In particular, bivy sacks often are only slightly larger than a sleeping bag and are typically configured to only contain a single occupant.

Still, using a tent or bivy sack with a sleeping bag includes certain disadvantages and/or problems. For example, a camper must purchase and care for each individually. Also, a camper must protect each individually and protect each from damage caused by the other. In another example, a camper may spend considerable effort and time maintaining each wherein a camper may be required to clean out an internal portion of each.

Further, tents/bivy sacks and sleeping bags may be made by various manufacturers, of varying materials, shapes and sizes, and therefore there may be compatibility issues, such as the fabric of one being too abrasive for the fabric of the other. Still further, wherein a tent/bivy sack may be configured to store items, a camper may store items therein and may be required to exit, at least partially, from a sleeping bag to gain access to the stored items, thereby exposing the camper to cold within the tent/bivy sack. Further, items stored outside of a sleeping bag will be exposed to extreme temperatures and may freeze or otherwise be damaged or less desirable to use.

What is needed is a sleeping system that solves one or more of the problems herein described or that may come to the attention of one skilled in the art after becoming familiar with this application.

SUMMARY OF THE INVENTION

The present invention has been developed in response to the present state of the art, and in particular, in response to the problems and needs in the art that have not yet been fully solved by currently available sleeping bags. Accordingly, the present invention has been developed to provide a combination sleeping bag and system.

There may be a combination sleeping bag system that may include a tent member, a sleeping bag, and/or a storage cavity. The tent member may include a tent base, a tent wall, and/or a tent aperture. The tent wall may be coupled to the tent base. The tent aperture may extend through the tent wall. The sleeping bag may define a sleeping cavity, may extend through the tent aperture, and may include a head portion disposed within the tent interior, and a foot portion disposed exterior the tent member. There may be a storage cavity that may be accessible from the sleeping cavity and/or may extend therefrom.

In one embodiment, there may be a selectably sealable aperture providing access between the sleeping cavity and the storage cavity. The storage cavity may include capacity to compressively enclose the sleeping bag and/or tent member and/or both. There may be a rod sheath coupled to an exterior of the storage cavity. There may be a bottom outer member including water-proof and abrasion-resistant material. The bottom outer member may extend over a bottom surface of the tent member and/or the sleeping bag and/or any portions thereof. There may be a selectably sealable aperture providing direct access between the storage cavity and an exterior of the sleeping bag. Also, an exterior surface of the system may be substantially contiguous across the tent member and the sleeping bag. Additionally, there may be an entrance disposed through the tent wall.

In another embodiment, the tent aperture is substantially water-proof and substantially wind-proof. There may be a plurality of support rods coupled to and/or supporting the tent wall. A plurality of support rods may include a pair of longitudinal support rods slidably coupled to the tent wall and/or a transverse support rod coupled between the pair of longitudinal support rods and extending substantially perpendicular to a long axis of the sleeping bag. The sleeping bag may be removably coupled to the tent member.

In one embodiment, there may be a combination sleeping bag system for providing shelter to a user. The combination sleeping bag system may include an outer shell and/or an inner shell. The outer shell may be water-proof. The inner shell may be substantially enclosed by the outer shell. The inner shell may define a sleeping cavity and/or a storage cavity. The storage cavity may be accessible from the sleeping cavity.

There may be a selectably sealable aperture providing access between the sleeping cavity and the storage cavity. The storage cavity may include sufficient capacity to compressively enclose the sleeping bag. There may also be a selectably sealable aperture providing direct access between the storage cavity and an exterior of the sleeping bag. There may be a cinch device coupled about an interface between a storage portion and a sleeping portion. There may further be a rod sheath coupled to an exterior of the outer shell Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
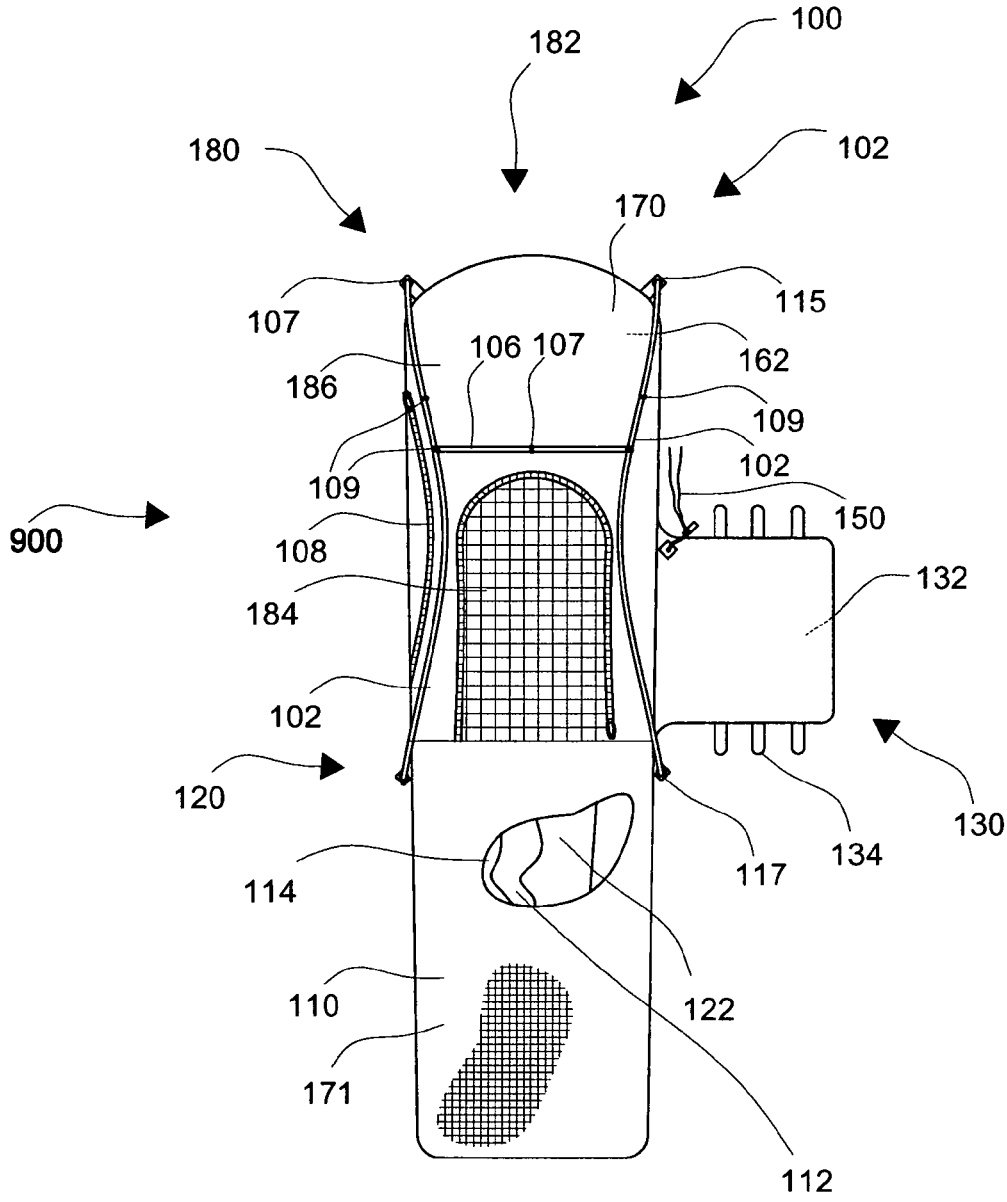
FIG. 1 illustrates a top plan view of a combination sleeping bag system according to one embodiment of the invention.
Figure 2:
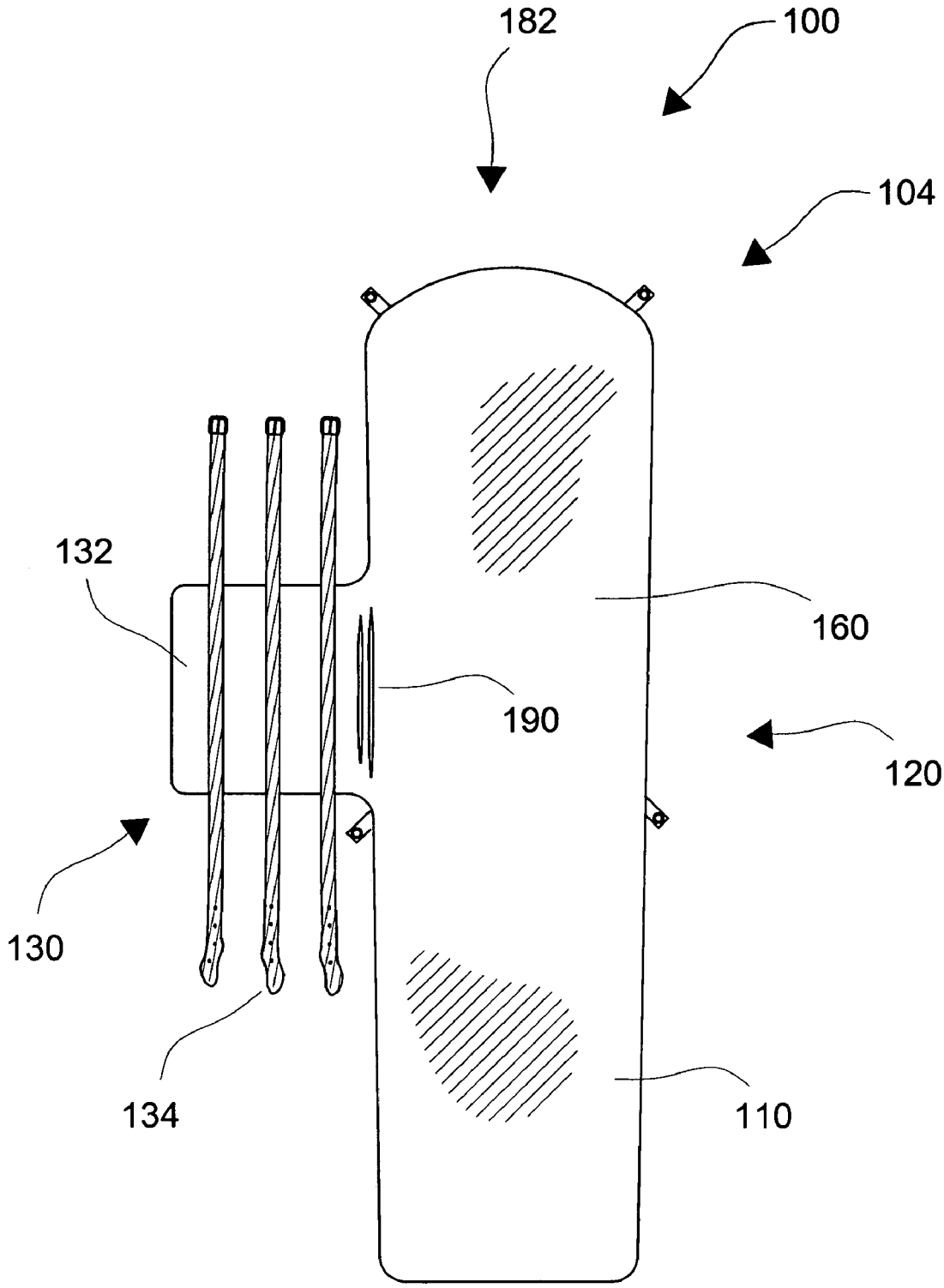
FIG. 2 illustrates a bottom plan view of a combination sleeping bag system according to one embodiment of the invention.
Figure 3:
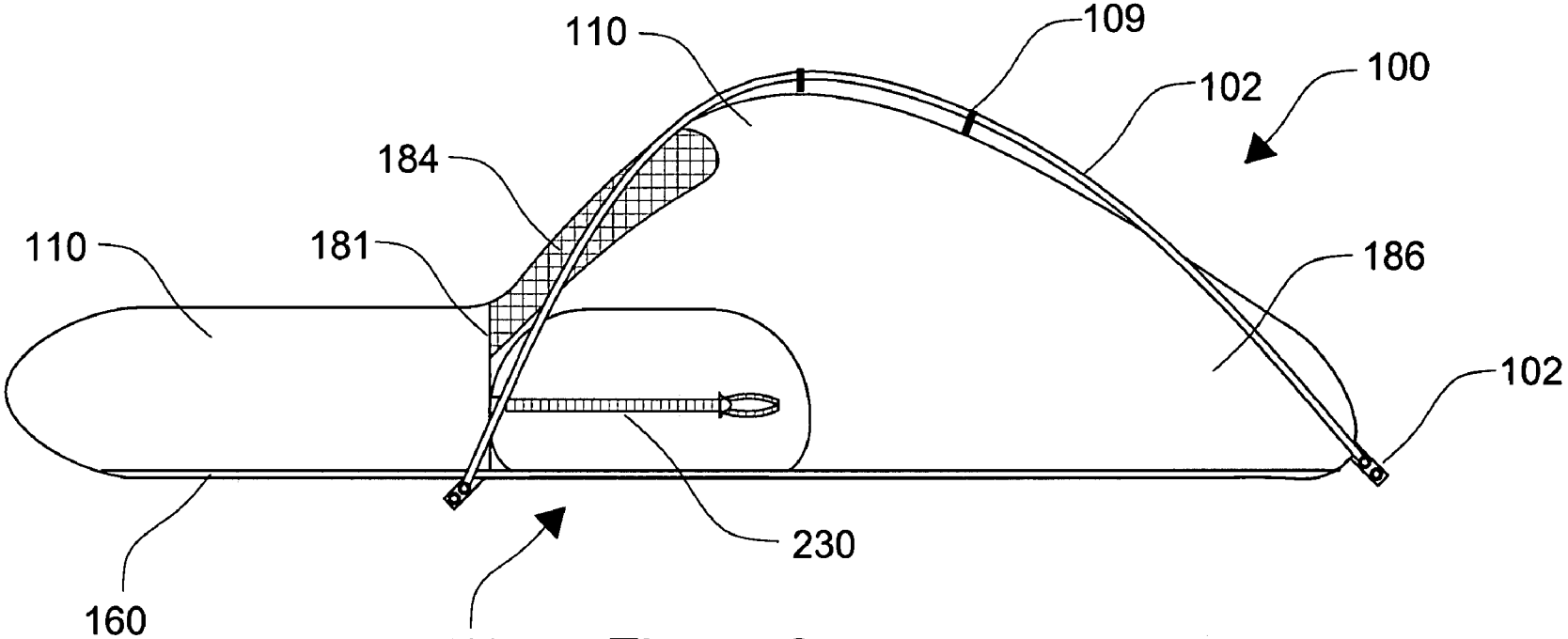
FIG. 3 illustrates a side plan view of a combination sleeping bag system according to one embodiment of the invention.
Figure 4:
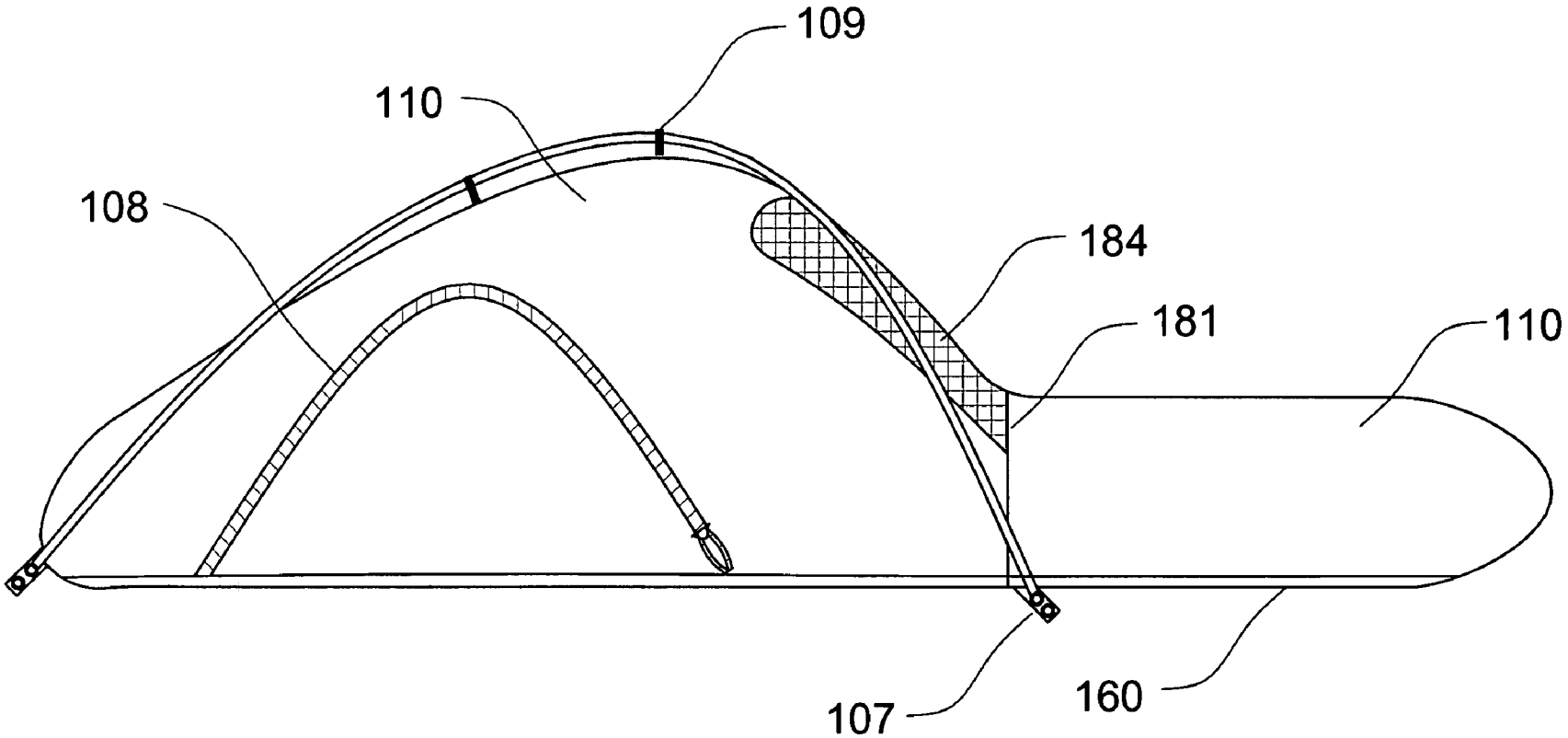
FIG. 4 illustrates a side plan view of a combination sleeping bag system according to one embodiment of the invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

FIGS. 1-5 illustrate top 102, bottom 104, and three side plan views of a combination sleeping bag system, respectively, according to one embodiment of the invention. There is shown a tent member 180. The tent member 180 may include a tent base 160, a tent wall 186, and a tent aperture 181. The tent wall 186 may be coupled to the tent base 160 and may define a tent interior. The tent aperture 181 may extend through the tent wall 186. There is shown a sleeping bag 183 that may define a sleeping cavity. The sleeping bag 183 may extend through the tent aperture 181. The sleeping bag 183 may include a head portion 192, a foot portion 194, and/or a storage portion or storage cavity 132. The head portion 192 may be disposed within the tent interior. The foot portion 194 may be disposed exterior the tent member 180. The storage cavity 132 may be accessible from the sleeping cavity. In one non-limiting example, the combination sleeping bag system may include a tent having a hole with a sleeping bag extending therethrough. In another non-limiting example, the combination sleeping bag system may include a tent having an elongated tail having an insulated sleeping cavity and a storage cavity therein.

There is illustrated an outer shell 110, that may include substantially water-proof and/or substantially flexible material. The outer shell 110 may be included in the tent member and/or the sleeping bag 183. Example materials include, but are not limited to solid sheets and/or woven materials such as cloth and/or fabric that may include one or more layers of water resistant and/or water repellant material such as materials produced under the trade name Gore-Tex®. There is illustrated a tiered cutaway view showing an inner shell 112 that may be coupled to the outer shell 110 and may be substantially coextensive therewith. There may be included one or more layers of thermally insulating material 114 such as but not limited to fibrous material, reflective material, material configured to produce a multiplicity of hollow chambers, and any other material known in the art to have thermally insulating properties. Typically, thermally insulating material 114 is disposed between the inner 112 and outer shells 110 and substantially coextensive thereto.

The outer shell 110 as shown also includes an upper outer member 170 defining a tent cavity 162 and a Lower outer member 171. The inner shell 112 as shown includes an upper inner member substantially enclosed by the tent cavity 162; and a lower inner member 112 substantially coextensive with the lower outer member 171, enclosed thereby, and coupled thereto. There is also a sleeping cavity 122 defined by the inner shell 112. There is also a storage cavity 132 defined by the inner shell 112 and accessible from the sleeping cavity 122. The illustrated storage cavity 132 extends substantially perpendicularly from a shoulder portion 900 of the s1eeping cavity 122 such that items stored therein may be stored in close proximity to the sleeping cavity but not under the user during use. There is a bottom outer member 160 that may be configured to protect a bottom of the sleeping bag. In particular, the bottom outer member 160 may comprise rugged, water-proof, and/or durable material.

When used in this application, the terms upper and lower refer to portions intended to be proximate or at least associated with upper and lower body portions of a user respectively when a device, member, or system is in use. When used in this application, the terms top and bottom refer to portions intended to be proximate or at least associated with air and ground respectively when a device, member, or system is in use. When used in this application, the term side refers to portions bordering at least two of a top, bottom, upper, and lower portion, member, and/or device. The terms top, bottom, upper, and lower are not necessarily mutually exclusive.

The inner shell 112 and/or outer shell 110 may define one or more cavities and or bag portions. There is illustrated a sleeping cavity 122 and a sleeping portion 120. The sleeping cavity 122 may have a volumetric capacity sufficient to at least permit substantial occupancy of at least a single desired user. The sleeping portion 120 may substantially envelope the sleeping cavity 122 and may define an exterior surface thereof.

As an example, wherein the desired user is an average camper, a sleeping cavity 122 may be configured to have sufficient capacity to allow an average sized camper to sleep with a majority of the body of the average camper disposed within the sleeping cavity. As another example, wherein the desired user may be a child within a range of children having known weights and proportions, a sleeping cavity 122 may have sufficient capacity to allow such to sleep with a majority of the body disposed therein.

There is illustrated a storage cavity 132 and a storage portion 130. The storage cavity 132 may have a volumetric capacity sufficient for desired storage needs. Examples of items upon which storage needs may be based include but are not limited to: boots, shoes, clothing articles, camping articles (such as, but not limited to, flashlights, matches, knives, bug spray, and tarps), personal care products (such as, but not limited to, lotion, medicine, herbal remedies, heating pads, first aid supplies, cosmetics, and deodorant/antiperspirant), and electronics (such as, but not limited to, PDAs, MP3 players, clocks, alarms, electronic medical devices, and sensors). The storage cavity 132 may advantageously permit storage of articles in close proximity to the sleeping cavity 122.

The storage cavity 132 may include one or more partitions that may be configured according to anticipated needs. For example, there may be pocket like partition that may be configured to securely contain an MP3 player within a storage cavity that may have a capacity far exceeding the size of the MP3 player. In another example, a partition may include a substantially planer partition configured to form a pair of compartments within the storage cavity 132, wherein a first compartment is vertically disposed over a second compartment. In a still further example, a partition may include a selectably sealable section that may be configured to contain one or more articles intended to be kept physically separated from other objects.

The outer shell 110 may include one or more surfaces. There is illustrated a bottom surface 160 and a top surface 170. A bottom surface 160 may include one or more portions of the outer shell 110 that may be configured to be in contact with a floor or with the ground when the sleeping bag 100 is in typical use. A top surface 170 may include one or more portions of the outer shell 10 that may be configured to not be in contact with a floor or with the ground when the sleeping bag 100 is in typical use.

A bottom surface 160 may include one or more layers of materials. In one example, a bottom surface 160 may include materials configured to be rugged, water-proof, water-resistant, durable, abrasive, and/or skid-proof. A bottom surface 160 may include a textured exterior that may be configured to more securely couple the sleeping bag to the ground, thereby reducing transverse motion and/or the likelihood of transverse motion of the sleeping bag during use. Advantageously, a bottom surface 160 may protect a user and a sleeping bag from wear and tear, heat, cold, abrasion, sand/dirt/mud etc. that may be associated with contact with a floor and/or ground. A bottom surface 160 may extend a distance vertically up each side of the bag or may extend only substantially vertically under the bag.

A top surface 170 may include one or more layers of materials. In one example, a top surface 170 may include materials configured to be rugged, durable, water-proof, water-resistant, durable, and/or breathable. A top surface 170 may include decorations such as but not limited to logos, depictions, designs, and/or textures. Advantageously, a top surface 170 may protect a user from the elements, such as from wind, rain, snow, hail, cold air, hot air, etc.

There is illustrated a head enclosure 180 disposed at a head 182 of the sleeping bag 100. A head enclosure 180 may be configured to enclose a head of a user and may include one or more features configured to give comfort, security, protection, freedom, etc. to a user. There is shown a mesh layer 184 included in the head enclosure 180 that may be configured to permit a user to see external the sleeping bag 100 when enclosed therein and may be configured to prevent entry of objects, such as insects, into the sleeping bag 100. There may be one or more layers, leaves, portions, and/or surfaces that may be configured to selectably cover and/or seal the mesh layer, thereby permitting a user to seal the sleeping bag from water, wind, snow, sound, etc. despite the presence of the mesh layer 184.

The head enclosure 180 may comprise an additional outer layer 186 that may surround and or encompass a portion of the outer layer 186. The head enclosure 180 may include one or more support rods 102 that may extend substantially parallel to the long axis of the sleeping bag 100. There may be a transverse support rod 106 that may extend substantially perpendicular to the long axis of the sleeping bag 100. A support rod 102 may be coupled to an exterior of the sleeping bag. A support rod 102 may be coupled to a strip of material including one or more holes, apertures, coupling portions, rivets, loops, etc. Wherein a strip of material includes a plurality of holes, one or more holes of the strip of material may be used to mount a securing device, such as a stake that may be used to couple the sleeping bag to a surface such as the ground, thereby restricting motion of the sleeping bag over the ground. There is shown a plurality of strip of material coupled to one or more support rods 102 and configured to couple a support rod 102 to the additional outer layer 186.

There is shown a pair of strips of material with holes that are top coupling strips 109 coupled to a top exterior portion of the head enclosure. The top coupling strips 109 each include a loop, hole, or other coupling means for slidably securing a longitudinal support rod 102 therethrough, wherein the longitudinal support rod 102 may then support the additional outer layer, forming a tent-like structure thereby. The pair of longitudinal support rods 102 are in turn supported by a transverse support rod 106 extending substantially linearly between each of the top coupling strips 109 and coupled thereto, thereby restricting motion of the longitudinal support rods 102.

The longitudinal support rods 102 are each coupled at bottom coupling strips 107, one at each end of each longitudinal support rod 102. Preferably, a distance from a first bottom coupling strip 115 to a second bottom coupling strip 117 is less than a length of a longitudinal support rod 102, thereby forcing a longitudinal support rod 102 to bend when coupled thereto, thereby enabling a longitudinal support rod to provide an arc of support to which the additional outer layer 186 may be coupled, thereby keeping the additional outer layer 186 lifted and defining a tent cavity therein. Preferably, the tent cavity is large enough to permit a user to sit upright without pressing against the additional outer layer 186.

There is shown an entrance aperture 108 through the additional outer shell 186 that is configured to permit entry of a user into the tent cavity 162. The entrance aperture 108 is disposed through a side portion of the additional outer shell 186. The additional outer shell 186 may extend over a top, side, top, bottom of the sleeping bag 100 and/or any combination thereof. For example, the additional outer shell 186 may extend from about a halfway point or any other point of the sleeping bag system 100 such as but not limited to a one third point, a two thirds point, a knee level, a hip level, and a chest level, and may extend about and/or over the top half of a sleeping bag like structure enclosing it in a tent like structure. A bottom surface of the upper half of the inner member and/or thermal insulating materials may be coupled to, integral to, or unattached to the additional outer shell 186. In one example, the bottom half of the sleeping bag system includes only a single outer shell that is water-proof and that has a rugged bottom surface. The top half 510 of the sleeping bag system may include a normal sleeping bag top half that may be enclosed in a tent-like structure having a water-proof outer shell and a rugged bottom surface.

There may be one or more mesh layers 184 coupled to an exterior or an interior of an outer shell 186 and/or an additional outer shell 186. A mesh layer 184 may be coextensive with an outer shell 186 and/or additional outer shell 186. There may be one or more apertures through a mesh layer 184 and/or an outer shell 186 and/or an additional outer shell 186. In the illustrated example, there is a layer of mesh material configured to prevent insects from passing into the tent cavity. Coextensive with the layer of mesh material is a selectably sealable port through the additional outer shell 186, wherein a user may open an aperture through the water-proof additional outer shell 186 leaving only a layer of insect-proof mesh material, thereby permitting light and air to pass freely into the tent cavity, but restricting access by insects and the like.

There are also shown a plurality of straps 134 coupled to the outer shell 110. In one example, there are three straps 134 that are coupled to a bottom surface 160 of an outer shell 110 about a storage portion 130. The straps as shown are disposed substantially parallel a long axis of the sleeping bag 100 and may be configured to facilitate storage of the sleeping bag 100.

The outer shell 110 may include one or more apertures that may each include one or more sealing devices. Preferably, an aperture through the outer shell is disposed through the top surface, thereby reducing the likelihood that dirt, mud, vegetation, and/or sand may enter the aperture. However, it is envisioned that under circumstances where an aperture may be advantageously disposed through a bottom surface 160, and aperture could be disposed therethrough. In the illustrated example, the outer shell includes an entrance aperture 108 through a first outer shell 110, and a pillow access aperture 220, and a second access aperture 230, each through a second outer shell. The second access aperture 230 may extend to any length. In one example, the second access aperture 230 extends longitudinally down the sleeping bag 100 and ends proximate a boundary between upper and lower shell members.

An entrance aperture 108 may be disposed through the outer shell 110 and the inner shell 112. The entrance aperture 108 may extend along one or more sides of the sleeping bag 100 and may be sufficiently large to facilitate entry of a user into a sleeping cavity 122 from external the sleeping bag 100. The entrance aperture 108 preferably includes a sealing device 250 configured to permit selectable sealing of the entrance aperture. The sealing device 250 may be any sealing device known in the art including but not limited to a zipper, hook and loop, interlocking flexible members, buttons, snaps, and magnetic members, thereby permitting selectable sealing of the entrance aperture, including a capability to seal only a portion thereof.

A sleeping bag 100 may include a pillow access aperture 220 that may be in, under, or adjacent a head enclosure 180 and that may provide access to a pillow cavity. A pillow cavity may be disposed under a head enclosure 180 and may be configured to contain a pillow, thereby enhancing comfort of a user. Preferably, the pillow access aperture 220 includes a sealing device 250 configured to permit selectable sealing of the pillow access aperture 220, thereby enabling a user to seal a pillow within the pillow cavity. The sealing device 250 may be any sealing device known in the art including but not limited to a zipper, hook and loop, interlocking flexible members, buttons, snaps, and magnetic members, thereby permitting selectable sealing of the entrance aperture, including a capability to seal only a portion thereof. Preferably, the pillow access aperture 220 is disposed closer to a bottom surface 160 than an entrance aperture 108.

A storage portion 130 may include a second access aperture 230 that may be disposed through the outer 110 and inner 112 shells of the sleeping bag 100 at the storage portion 130, thereby providing access to the storage cavity 132 from external the sleeping bag 100. Preferably, the second access aperture 230 includes a sealing device 250 configured to permit selectable sealing of the second access aperture 230, thereby enabling a user to selectably seal the storage cavity 132 from external access. The sealing device 250 may be any sealing device known in the art including but not limited to a zipper, hook and loop, interlocking flexible members, buttons, snaps, and magnetic members, thereby permitting selectable sealing of the entrance aperture, including a capability to seal only a portion thereof.

There may be a plurality of storage portions. It is envisioned that the variety of shapes and configurations of storage portions 130 is plethoric. A storage portion 130 may extend from a sleeping portion 120 and/or another storage portion 130 in any imaginable shape, angle, and size. Further, a storage portion 130 may extend from any imaginable location on a sleeping portion 120 or other storage portion 130. A storage portion 130 may be adapted for a particular use.

Accordingly, a storage portion 130 may include a storage cavity that may be configured to contain an electronic device, such as a portable music player, such as an MP3 player. The storage portion 130 may include a storage aperture that may be configured to permit access to the electronic device and that may be sealable. Further, there may be an aperture that may or may not be part of the storage aperture and that may enable a user to extend a wire from the electronic device to the user, even when a storage aperture may be sealed at least partially. A storage portion may be proximate a head of the sleeping bag thereby facilitating access between a content of the storage portion and a head of a user.

A storage portion 130 may extend from a sleeping portion 120 as a general widening of the sleeping bag 100. The storage portion 130 may provide a widening of the sleeping bag 100 when an aperture is in an unsealed state. For example, a user may store a set of clothing inside a storage portion, wherein the storage portion 130 is preferably sealed from the sleeping portion 120 during a sleeping session of the user. When the user desires to dress, the user may unseal an aperture connecting the sleeping cavity 122 with the storage cavity 132. In such a configuration, a previously snug fitting sleeping bag 100 may be extended to provide increased space in which to maneuver while dressing. Thereby a sleeping bag 100 may be snug, having enhanced thermal characteristics during a sleeping section while storing a substantial quantity of clothing. Also, the same sleeping bag 100 may be roomy while a user may be dressing inside the sleeping bag 100, thereby enabling the user to more easily and with less frustration dress inside the comfort and warmth of a sleeping bag before perhaps exiting to a snowy, rainy, cold, etc. camp area.

There may be a need to store an object in a location distant from the hands and/or head of a user. As an example, there may be a medical, electronic, safety, comfort, etc. device that may be attached to a leg of a user or may be advantageously disposed adjacent towards a foot of the sleeping portion 120. There may be an external access aperture disposed through a storage portion 130 that may be used by a user to access, insert, and/or remove materials and/or objects from the storage cavity. Thereby, a second user may have access to a storage cavity disposed about a lower portion of a sleeping bag user's body. Therefore, a person having medical needs may be enabled to go on a camping trip and an assistant accompanying the person may be able to easily assist in medical needs.

Also there may be a pillow access disposed about a portion of the sleeping bag 100 that is not the head enclosure 180. Therefore, a pillow may be inserted and provide support and/or comfort to a portion of a user's body that is not a head. For example, a user may be enabled to insert a pillow into a pillow cavity that may be disposed in a location about where knees of the person may be disposed when the sleeping bag 100 is in use. Thereby a user may be provided with support under the knees, permitting an adjusted sleeping posture and enhancing a use experience of the user.

Another feature illustrated that may enhance a use experience of a user includes support rods that may be configured to form a triangular dome-like structure about the head of the user. One or more support rods may be configured to bend about an arc and form a triangular dome-like structure above the face of a user. Advantageously, a set of three rods configured to form a triangular pattern may not interfere with a central viewing angle through a mesh screen. It is envisioned that there are a great number of variations of the support rod shapes, sizes, number, configuration, placement, and/or orientations that may provide a similar dome-like structure having a substantial unobstructed viewing angle. It is envisioned that a pair of support rods may form a similar structure. Further, it is envisioned that more or less than three support rods may also be configured to form a similar structure.

Figure 6:
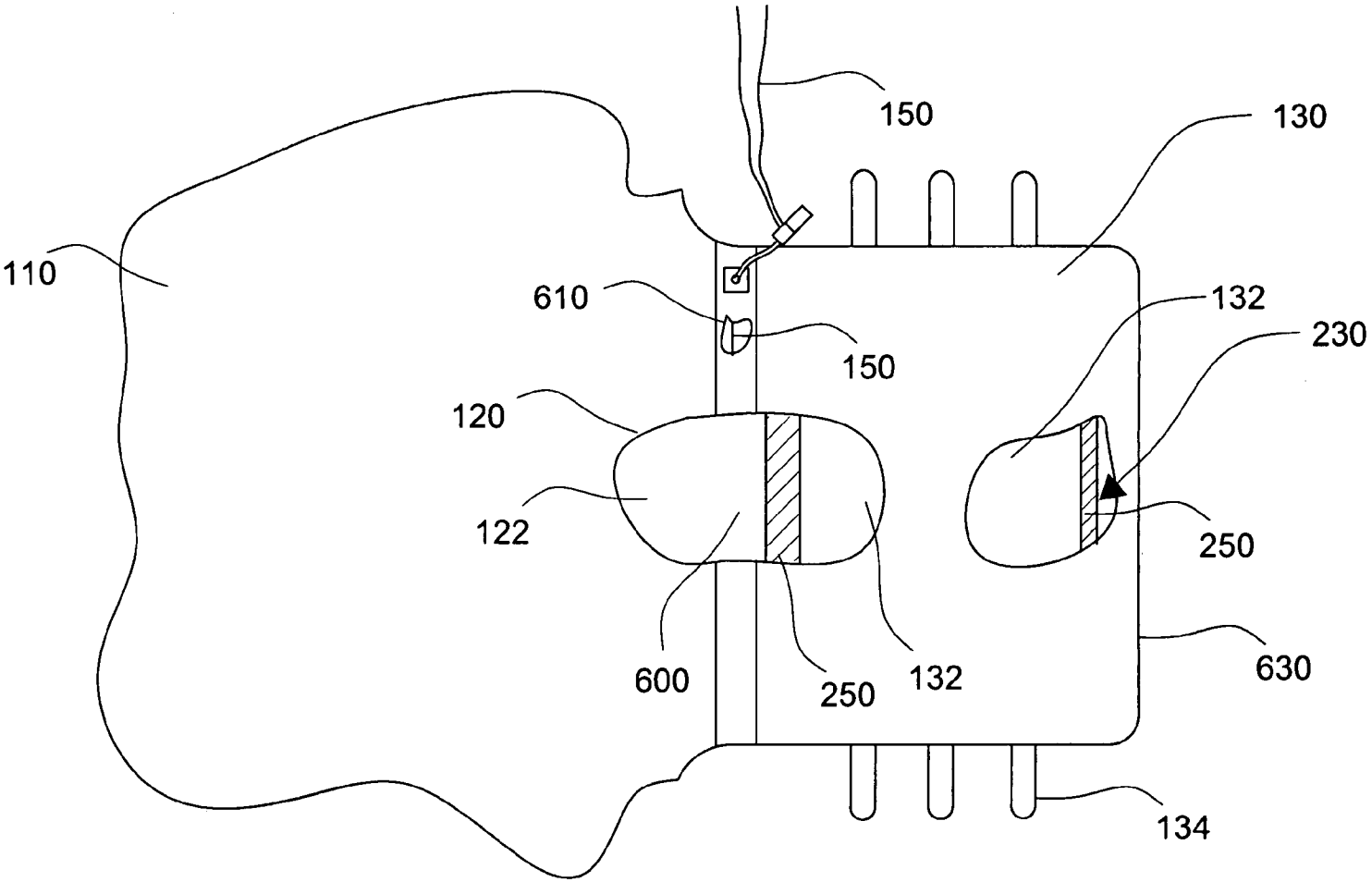
FIG. 6 illustrates a partial cutaway top plan view of a portion of a combination sleeping bag system including a storage portion according to one embodiment of the invention.

Turning to FIG. 6, there is shown a top portional plan view of a storage portion 130 of a sleeping bag 100 according to one embodiment of the invention. There is shown a storage portion 130 coupled to a sleeping portion 120 of a sleeping bag 100 (see FIG. 1). There is a cutaway view showing an internal view of both the sleeping portion 120 and the storage portion 130 including a first aperture sealing device 250. There is a cutaway view showing a storage cavity 132 and a second aperture sealing device 250. There is also illustrated a cinch cord 150 coupled to the storage portion 130 about the interface 510 between the storage portion 130 and the sleeping portion 120. There is a cutaway view showing a cinch cord 150 extending through a cinch sheath 512.

In operation, a user may be a least partially enclosed in the sleeping cavity 122 of the sleeping portion 120 and may store an object in the storage portion 130. The user may cause entry of the object into the storage portion 130 by either the first aperture 600 or the second aperture 230 and may toggle access to the storage cavity 132 through either of the first and second aperture sealing devices 250. Further, a user may actuate the cinch cord 150, typically by pulling the cinch cord 150, wherein the cinch cord 150 may shrink an effective circumference of the cinch sheath 512, thereby reducing an effective aperture size of the first aperture 600.

There is also shown a first access aperture 600 that may be disposed between the storage cavity 132 and the sleeping cavity 122. The first access aperture 600 may be configured to facilitate access to the storage cavity 132 by a user disposed at least partially within the sleeping cavity 122. The first access aperture 600 may be configured to permit physical access to the storage cavity 132 from the sleeping cavity 122. For example, the first access aperture 600 may permit a user disposed within the sleeping cavity to access contents of the storage cavity 132 without requiring the user to be exposed to the elements outside the outer shell 110.

A first access aperture 600 may be sealable, may be selectably sealable, and/or may be partially sealable. A first access aperture 600 may include on or more sealing devices 250. There may be any variety of sealing devices 250 known in the art, including but not limited to hook and loop, snaps, buttons, pressure adhesives, ties, tension springs, cords, sphincters, and/or zippers. A sealing device 250 may be actuatable from internal and/or external a sleeping cavity 122 and/or a storage cavity 132.

Figure 5:
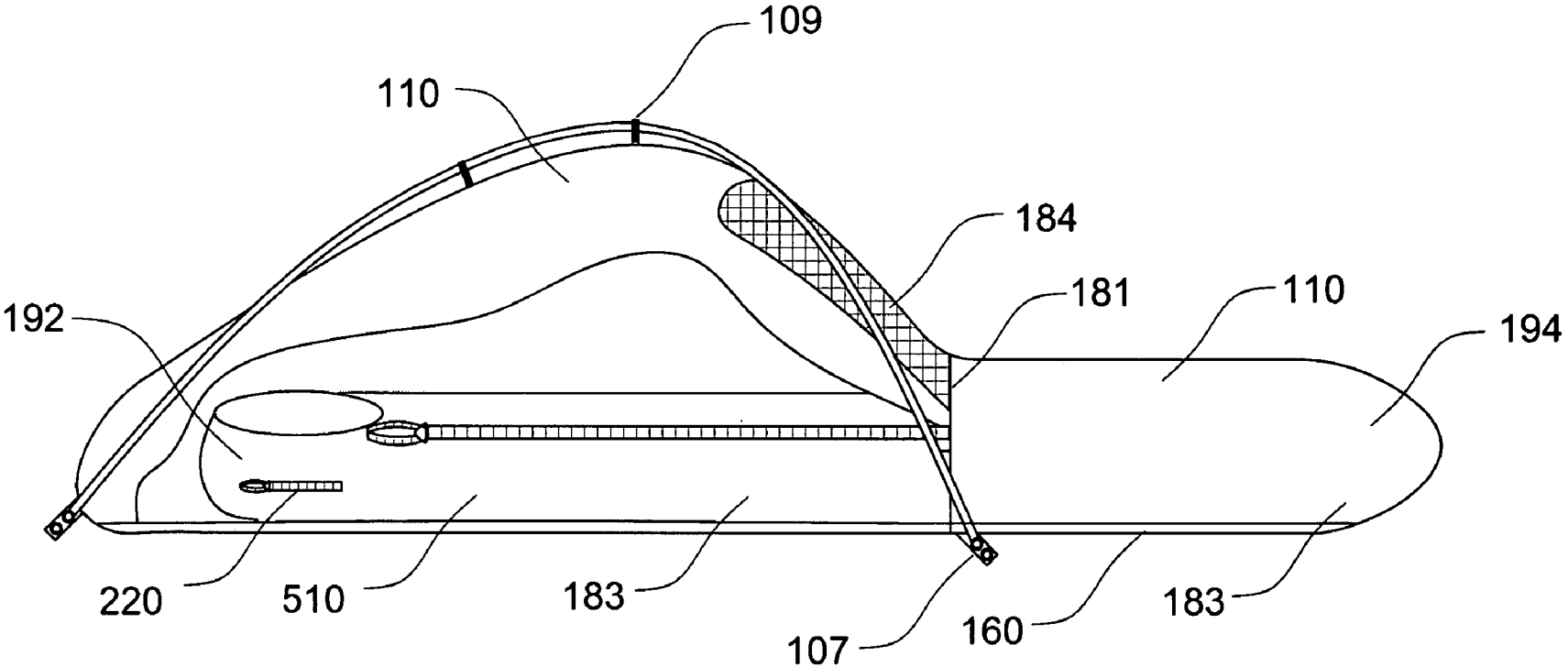
FIG. 5 illustrates a side plan view of a combination sleeping bag system with a cutaway showing an inside of a tent-like structure according to one embodiment of the invention.

In one example, there may be a pair of sealing devices. There may be a cord 150 disposed within a fabric sheath 610 coupled to the outer shell 110 adjacent an interface between the sleeping portion 120 and the storage portion 130. The cord 150 may be configured to enable partial closure of the first access aperture 600 in a sphincter-like manner. There may also be a zipper disposed internal the first access aperture 600 that may be configured to enable partial and/or complete closure of the first access aperture 600. The cord 150 may be configured to also facilitate containing the sleeping portion 120 within the storage portion 130 as shown in FIG. 5. There may be a second access aperture 230 having a sealing device 250 that may be at a distal end 630 of a storage portion 130 that may be configured to permit selectable access to the storage cavity 132.

Figure 7:
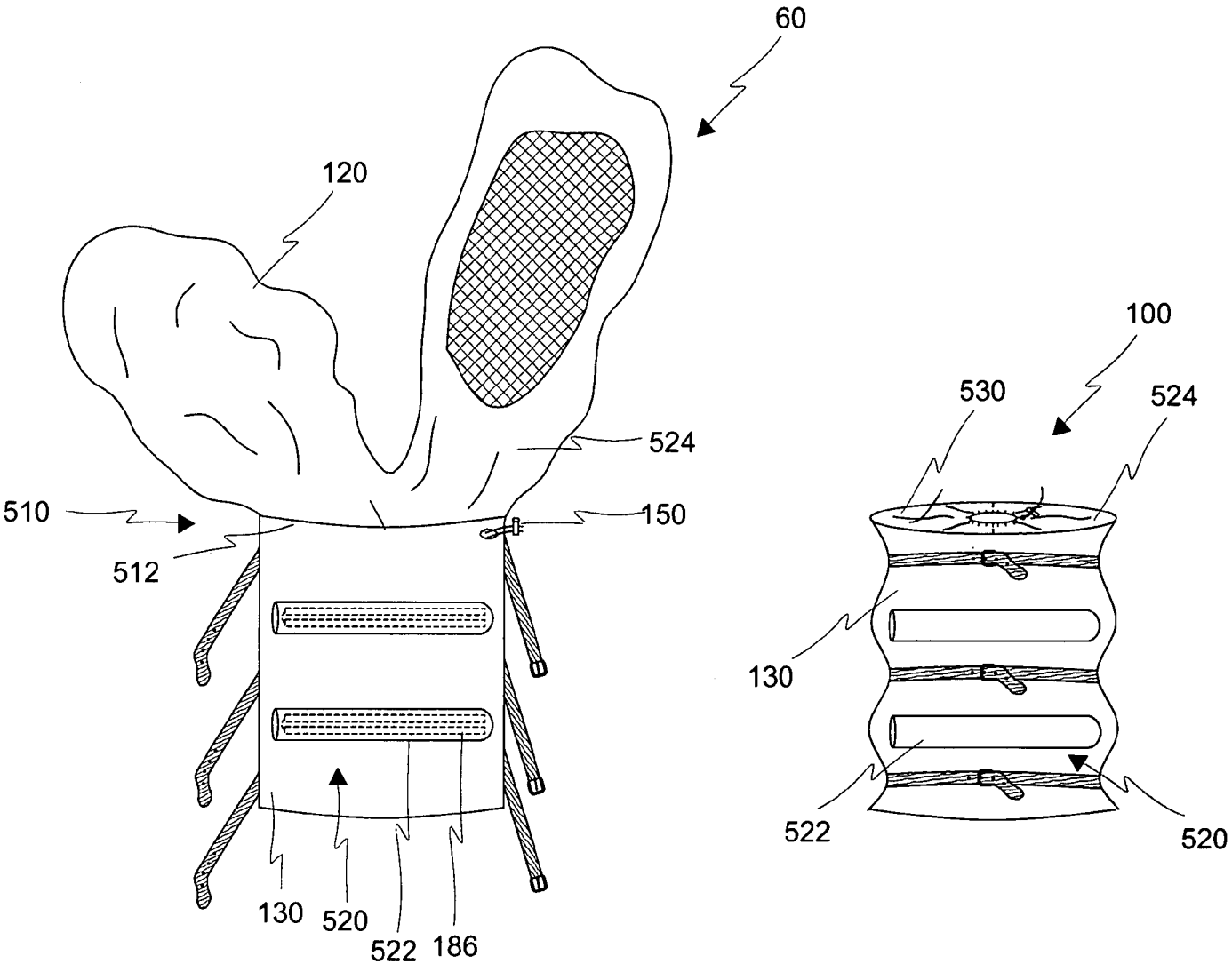
FIG. 7 illustrates side perspective views of stowing and stowed modes of a combination sleeping bag system according to one embodiment of the invention.

FIG. 7 illustrates perspective views of storing and storage of a sleeping bag 100 in a storage portion 130 according to one embodiment of the invention. There is shown a sleeping bag 100 including a storage portion 130 and a sleeping portion 120. Coupled about an interface 510 between the storage portion 130 and the sleeping portion 120 is a cinch cord 150 through a cinch sheath 512 that encircles the interface 510. There is also shown a rod storage sheath 520 including an elongated storage portion 522 and a rod sheath aperture 524.

In operation, a user may stuff the sleeping portion 120 into the storage portion 130. Also, support rods 186 may be placed into the rod storage sheath 520. A typical support rod 186 is segmented, and may be separated into the various segments, thereby shortening the minimum length required to store the support rod 186. Once the sleeping portion 120 is completely stuffed within the storage portion 130, the cinch cord 150 may be drawn tight, thereby restricting exit of the sleeping portion 120 from the storage portion 130. Wherein the rod sheath aperture 524 is disposed about a cap portion 530 of the resulting stored sleeping bag 100 the rod storage sheath 520 thereby bends an exit of any rods stored therein is restricted. A rod storage sheath 520 may be oriented in any direction and located at any position on an exterior of the sleeping bag. Wherein a bottom surface 160 (see FIG. 1) of a sleeping bag 100 may be substantially rigid, there may be ridges 190 (see FIG. 1) disposed about the interface 510 (see FIG. 1) of the bottom surface 160 (see FIG. 1) of the sleeping portion 120 and the bottom surface 160 of the storage portion 130 that may be substantially parallel to the axis of rotation of the sleeping portion 120 when the sleeping portion 120 is being stuffed into the storage portion 130, thereby facilitating bending of the bottom surface 160 at the interface 510 during stuffing.

It is understood that the above-described preferred embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

For example, it is envisioned that a sheet of cushion material may be inserted between the head portion of the sleeping bag and the tent base, thereby enhancing comfort of a user. Such a cushion material may comprise a foam pad such as may be constructed from acrylonitrile-butadiene rubber, such as that sold under the brand name of Nitrolite® by Nitron Industries at 185 Erten Street in Thousand Oaks, Calif. A cushion material, including but not limited to one as described above, may also be used to make a pillow pad configured to be inserted into a pillow cavity.

Finally, it is envisioned that the components of the device may be constructed of a variety of materials. There may be materials such as but not limited to: fibers (natural and/or synthetic), polymers, resins, plastics, rubbers, composites, metals, liquids, gases, fabrics, coated fabrics, multi-layer materials, transparent/translucent materials, reflective materials (including thermally reflective materials), leather, membranes (natural and/or synthetic), and/or meshes.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A combination sleeping bag system, comprising:
a tent member, including:
a tent base including a plurality of coupling strips;
a tent wall coupled to the tent base and defining a tent interior; and
a tent aperture through the tent wall;
a sleeping bag defining a sleeping cavity, extending through the tent aperture, and including:
a head portion disposed within the tent interior;
a foot portion disposed within the tent interior; and
a shoulder portion;
a plurality of support rods coupled to and supporting the tent wall, the support rods including:
a pair of longitudinal support rods slidably coupled to the tent wall; and
a transverse support rod coupled between the pair of longitudinal support rods at a medial portion of the longitudinal support rods and extending substantially perpendicular to a long axis of the sleeping bag;
wherein the distance between the coupling strips is less than the length of the longitudinal support rods forcing the longitudinal support rods to bend when coupled thereto; and
a storage cavity accessible from the sleeping cavity and extending substantially perpendicularly to a longitudinal axis formed by a line between the head and foot portions of the sleeping bag therefrom, wherein the storage cavity does not extend the entire length of a side of the sleeping bag system, the storage cavity including:
a first selectably sealable aperture providing access between the sleeping cavity and the storage cavity; and
a second selectably sealable aperture providing direct access between the storage cavity and an exterior of the sleeping bag;
wherein the storage cavity comprises capacity to compressively enclose both the sleeping bag and tent member, and
wherein the storage cavity extends outwardly from the shoulder portion in a coplanar orientation with a bottom of the tent member.

2. The sleeping bag of claim 1, further comprising a rod sheath coupled to an exterior of the storage cavity.

3. The sleeping bag of claim 1, further comprising a bottom outer member including water-proof and abrasion-resistant material.

4. The sleeping bag of claim 1, wherein an exterior surface of the system is substantially contiguous across the tent member and the sleeping bag.

5. The sleeping bag of claim 1, further comprising an entrance disposed through the tent wall.

6. The system of claim 1, further comprising a cinch device coupled about an interface between a storage portion and a sleeping portion.

7. A combination sleeping bag system, comprising:
a tent member, including:
a tent base;
a tent wall coupled to the tent base and defining a tent interior, and
a tent aperture through the tent wall;
a sleeping bag extending through the tent aperture and including:
a head portion disposed within the tent interior,
a foot portion disposed within the tent interior; and
a shoulder portion; and
a storage cavity accessible from the sleeping cavity and extending substantially perpendicularly to a longitudinal axis formed by a line between the head and foot portions of the sleeping bag therefrom, wherein the storage cavity does not extend the entire length of a side of the sleeping bag system, wherein the storage cavity further comprises a selectably sealable aperture providing direct access between the storage cavity and an exterior of the sleeping bag system, and wherein the storage cavity extends outwardly from the shoulder portion in a coplanar orientation with a bottom of the tent member.

8. The system of claim 7, wherein the tent aperture is substantially water-proof and substantially wind-proof.

9. The system of claim 7, further comprising a plurality of support rods coupled to and supporting the tent wall.

10. The system of claim 9, wherein the plurality of support rods comprises:

a pair of longitudinal support rods slidably coupled to the tent wail; and a transverse support rod coupled between the pair of longitudinal support rods and extending substantially perpendicular to a long axis of the sleeping bag.

11. The system of claim 7, further comprising a bottom outer member including water-proof and abrasion-resistant material.

12. The system of claim 7, wherein the sleeping bag is removably coupled to the tent member.

13. The system of claim 7 wherein the storage cavity comprises capacity to compressively enclose both the sleeping bag and tent member.

14. The system of claim 7, wherein the storage cavity further comprises a selectably sealable aperture providing access between the sleeping cavity and the storage cavity.

15. A combination sleeping bag system for providing shelter to a user, comprising:

an outer shell;

an inner shell substantially enclosed by the outer shell defining:

a sleeping cavity; and a storage cavity wherein the storage cavity does not extend the entire length of a side of the sleeping bag system, accessible from the sleeping cavity, wherein the storage cavity extends substantially perpendicularly to a longitudinal axis formed by a line between a head and a foot portion of the sleeping bag, the storage cavity disposed on the outer shell in a coplanar orientation with a bottom of the tent member and a plurality of support rods coupled to and supporting the tent wall, the support rods including:

a pair of longitudinal support rods slidably coupled to the tent wall; and a transverse support rod coupled between the pair of longitudinal support rods at a medial portion of the longitudinal support rods and extending substantially perpendicular to a long axis of the sleeping bag.

16. The system of claim 15, further comprising a selectably sealable aperture providing access between the sleeping cavity and the storage cavity.

17. The system of claim 15, wherein the storage cavity comprises capacity to compressively enclose a sleeping bag.

18. The system of claim 15, further comprising a selectably sealable aperture providing direct access between the storage cavity and an exterior of a sleeping bag.

19. The system of claim 15, further comprising a cinch device coupled about an interface between a storage portion and a sleeping portion.

20. The system of claim 15, further comprising a rod sheath coupled to an exterior of the outer shell.

* * * * *